US006101677A

United States Patent [19]

Takeuchi

[11] Patent Number: 6,101,677

[45] Date of Patent: Aug. 15, 2000

[54] CARRYING HANDLE MECHANISM FOR A PORTABLE EQUIPMENT

[75] Inventor: Katsuyuki Takeuchi, Tokyo, Japan

[73] Assignee: NEC Corporation, Tokyo, Japan

[21] Appl. No.: 09/049,948

[22] Filed: Mar. 30, 1998

[30] Foreign Application Priority Data

Mar. 31, 1997 [JP] Japan ..... 9-079321

[51] Int. Cl.[7] ..... A45C 13/22

[52] U.S. Cl. ..... 16/405; 16/113.1; 74/527

[58] Field of Search ..... 16/113.1, 405, 16/429; 294/15, 16, 28; 280/304.5, 655, 652; 74/527, 529

[56] References Cited

U.S. PATENT DOCUMENTS

| | | | |
|---|---|---|---|
| 2,717,161 | 9/1955 | Orr | 280/655 |
| 3,734,441 | 5/1973 | Lux | 16/115 |
| 4,256,320 | 3/1981 | Hager | 190/18 A |
| 4,337,674 | 7/1982 | Lawrence | 74/527 |
| 4,523,773 | 6/1985 | Holtz | 280/655 |
| 5,127,664 | 7/1992 | Cheng | 280/655 |

FOREIGN PATENT DOCUMENTS

| | | | |
|---|---|---|---|
| 3046286 | 7/1982 | Germany | 16/115 |
| 6-89124 | 3/1994 | Japan . | |

OTHER PUBLICATIONS

Toshiyoshi, S., "Handle for Projector,"Patent Abstracts of Japan, Publication No. 07181594, July 21, 1995.

*Primary Examiner*—Chuck Y. Mah
*Attorney, Agent, or Firm*—Whitham, Curtis & Whitham

[57] ABSTRACT

Disclosed is a carrying handle mechanism for a portable equipment which has a shaft disposed on a body of the portable equipment and having a first engageable portion and a second engageable portion, the shaft arranged to be forwardly/backwardly slidable with respect to the body; a carrying handle fixed to the shaft; and a lock mechanism which includes a control member which is arranged that the control member may be engageable with the shaft under a predetermined pressing force at all times and the control member is engageable with the first engageable portion when the carrying handle is in an accommodated position, and the control member is engageable with the second engageable portion when the carrying handle is in a pulled-out use position. The carrying handle is pulled out from the body, whereby the carrying handle is automatically locked and fixedly retained in the pulled-out use position, When the carrying handle is accommodated, the lock mechanism is released, whereby the carrying handle is somewhat pushed into the body by a spring force applied to the carrying handle.

10 Claims, 8 Drawing Sheets

CARRYING HANDLE MECHANISM FOR A PORTABLE EQUIPMENT

BACKGROUND OF THE INVENTION

1. Field of the Invention

The present invention relates to a carrying handle mechanism, and more particularly to a carrying handle mechanism for use in a carriage, an installation or the like of a portable equipment such as a projector.

2. Description of the Prior Art

Heretofore, in a portable equipment, for example, in a projector for magnifying a picture and an image reflected on a chatty ray tube by means of a lens and for projecting the magnified picture and image on an appropriate screen, recesses for gripping by an operator's hands have been formed on both of right and left edges on a bottom surface of a body of the projector. When the portable equipment is moved and its layout is modified, some equipment are moved by gripping the recesses on the body with fingers and lifting the equipment. In other equipment, hand grips are screwed on both of right and left side surfaces of the body. In order to move and modify the equipment, these hand grips are gripped, whereby the equipment is lifted and modified.

When the recesses are provided on the bottom surface of the portable equipment body, the recesses provided on both of right and left sides on the bottom surface are only gripped with the fingers. Thus, the fingers are prone to be removed from the recesses. Disadvantageously, it is very difficult to hold the portable equipment body.

Furthermore, if the portable equipment such as the projector takes such an attitude that it is turned upside down, right-side down or left-side down, the portable equipment cannot be lifted. In fact, it is not therefore easy to use the portable equipment.

Moreover, if the portable equipment body is provided with a carrying handle screwed on the side surface thereof, there arise a problem in that a removal of the carrying handle is troublesome during non-use and another problem in appearance in that screw heads remain after the removal.

In addition, when the carrying handle is not removed, a space is required for the mounted carrying handle, and the appearance problem is still left.

Japanese Patent Laid-open No. 6-89124 disclosed on Mar. 29, 1994 discloses a carrying handle mechanism in which the carrying handle is mounted to the portable equipment body through a rotating arm and a sliding groove and a pivot of the rotating arm is slid in the groove so that the carrying handle may be accommodated in the body at the time of accommodation.

However, in such a conventional example, it is difficult to retain the carrying handle fixedly in an accommodated position or a pulled-out use position because the carrying handle mechanism does not have a function for fixing a position of the carrying handle against the portable equipment body. Therefore if the portable equipment such as the projector takes such an attitude that it is turned upside down, right-side down or left-side down, the portable equipment cannot be lifted because the carrying handle easily and freely moves. In fact, it is not therefore easy to use the portable equipment.

SUMMARY OF THE INVENTION

It is an object of the present invention to provide a carrying handle mechanism for a portable equipment improving the above shortcomings of the prior art, capable of being, on demand, pulled out and used from a side surface of a body of the portable equipment and of being retained in a stable state.

And, another object of the present invention is to provide a carrying handle mechanism for a portable equipment having an improved ease of use in which an accommodating operation is simple.

In order to achieve the above object, the present invention employs a basic technique arrangement as described below. That is, according to the present invention, a carrying handle mechanism for a portable equipment has a shaft disposed on a body of the portable equipment and having a first engageable portion and a second engageable portion, the shaft arranged to be forwardly/backwardly slidable with respect to the body; a carrying handle fixed to the shaft; and a lock mechanism which includes a control member which is arranged so that the control member may be engageable with the shaft under a predetermined pressing force at all times and the control member is engageable with the first engageable portion when the carrying handle is in an accommodated position, and the the control member is engageable with the second engageable portion when the carrying handle is in a pulled-out use position.

In the carrying handle mechanism for portable equipment of the present invention, in order to solve the above-described problems of the prior art, the carrying handle is pulled out from the portable equipment body, whereby the carrying handle is automatically locked and fixedly retained in the pulled-out use position. Therefore, the portable equipment body can be easily lifted and moved by grasping and gripping the carrying handle with hands. Thus, unlike the prior art in which an operation is carried out only by gripping the body with fingertips, the portable equipment body can be very stably arranged in various attitudes such as an upside-down attitude, a right-side-down attitude or a left-side-down attitude.

Furthermore, when the carrying handle is accommodated, a release of the lock mechanism allows the carrying handle to be somewhat pushed into the portable equipment body by a spring force applied to the carrying handle. Accordingly, the accommodating operation is facilitated and thus a treatment is simplified.

BRIEF DESCRIPTION OF THE DRAWINGS

For a more complete understanding of the present invention and the advantages thereof, reference is now made to the following description taken in conjunction with the accompanying drawings.

DETAILED DESCRIPTION OF THE PREFERRED EMBODIMENTS

An arrangement of an example of carrying handle mechanisms for a portable equipment according to the present invention will be described below in detail with reference to the accompanying drawings.

Figure 1:
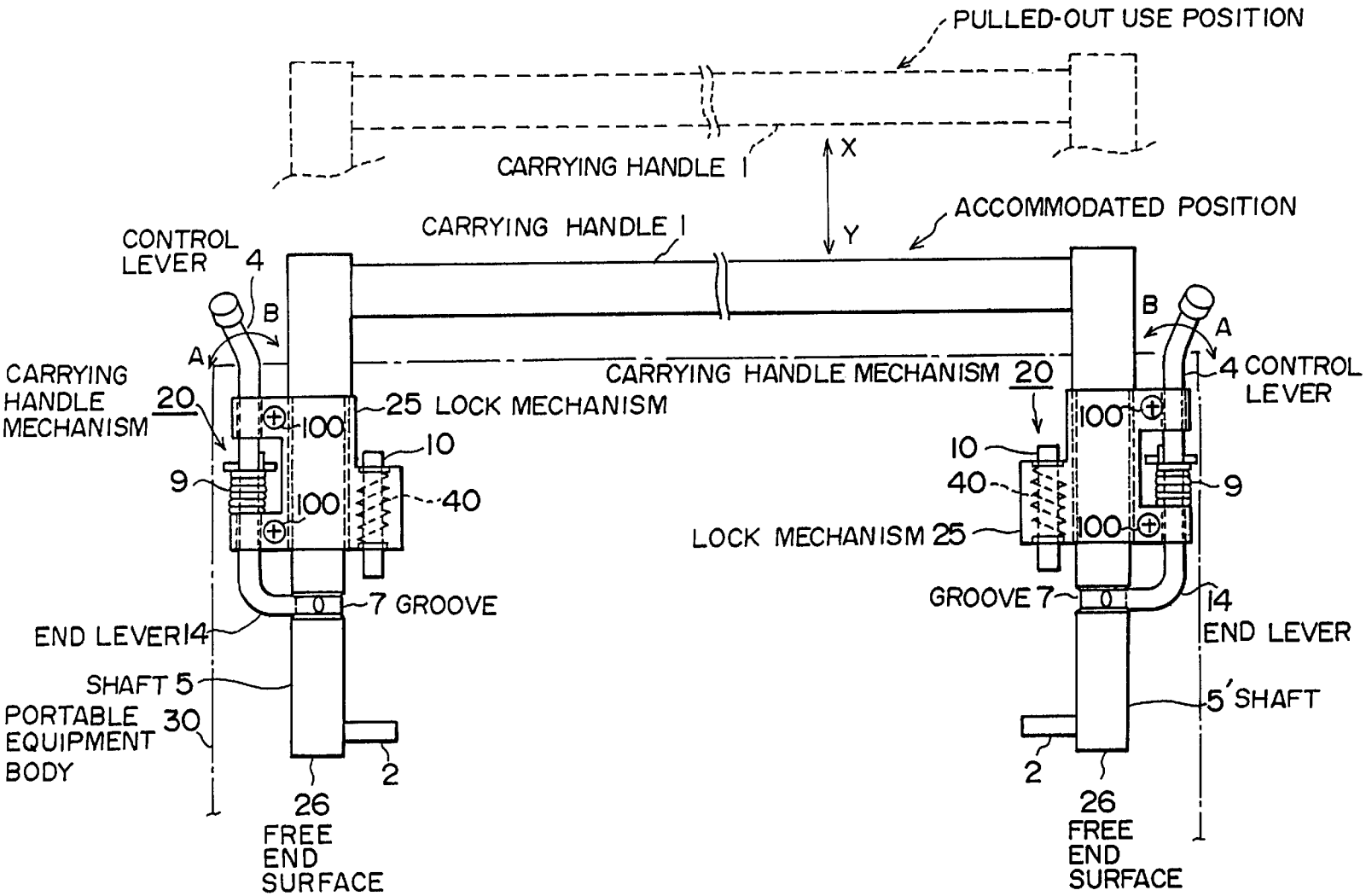
FIG. 1 is a plan view of a first embodiment of carrying handle mechanisms for a portable equipment according to the present invention in an accommodated position.

FIG. 1 is a plan view of a first embodiment of carrying handle mechanisms 20 for a portable equipment according to the present invention in an accommodated position. In this drawing, the carrying handle mechanisms 20 have a pair of shafts 5, 5' disposed on both sides of a portable equipment body 30 and arranged to be forwardly/backwardly slidable in a pulling-out direction X; an accommodating direction Y through lock mechanisms 25 with respect to the body 30 and a carrying handle 1 fixed to same ends of the shafts 5, 5' for connecting therebetween. The lock mechanisms 25 include control levers 4 having end levers 14 engageable with the shafts 5, 5' under predetermined pressing forces at all times by, for example, action of appropriate springs 9. The lock mechanisms 25 are fixed to the body 30 by screws 100. The shafts 5, 5' include grooves 7 which the end levers 14 of the control levers 4 are fitted into when the carrying handle 1 is in the accommodated position. Free end surfaces 26 of the shafts 5, 5' are engageable with the end levers 14 of the control levers 4 when the carrying handle 1 is in a pulled-out use position.

The carrying handle mechanisms 20 will be described in more detail together with its operation.

Figure 3:
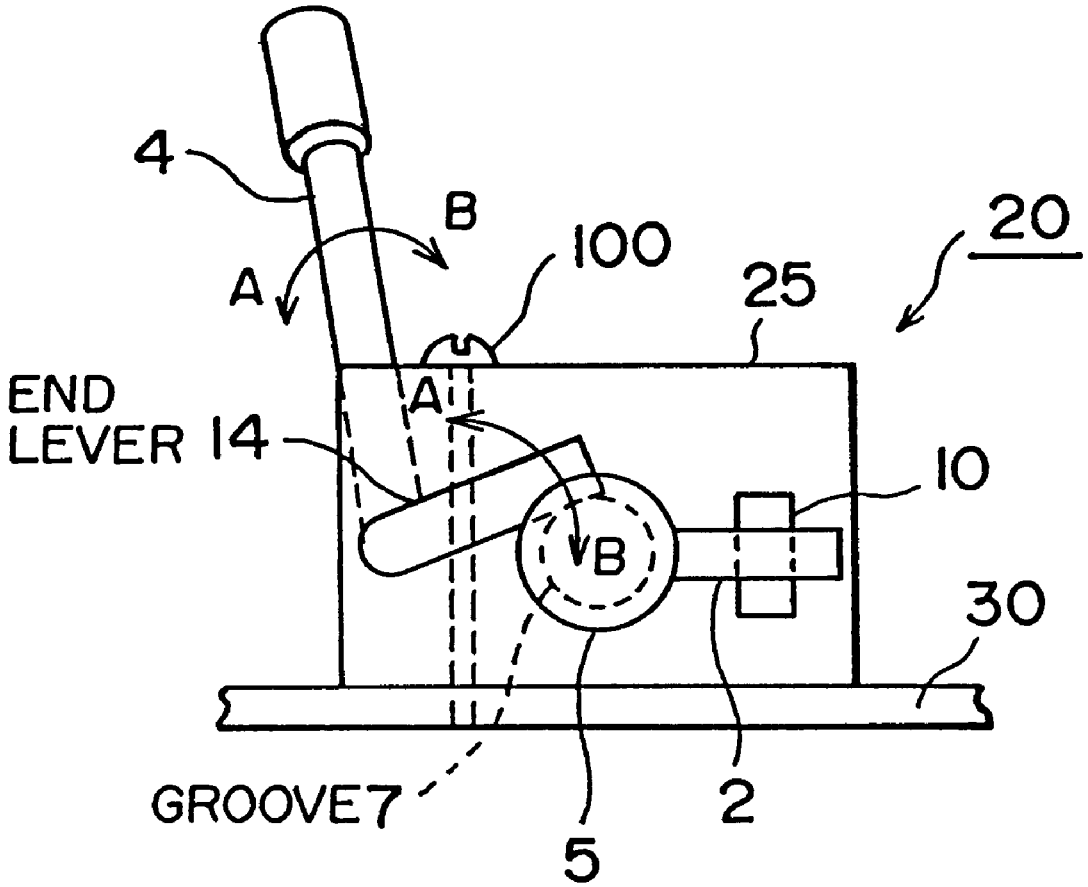
FIG. 3 is a front view of the first embodiment of the carrying handle mechanisms for a portable equipment shown in FIG. 1.
Figure 5:
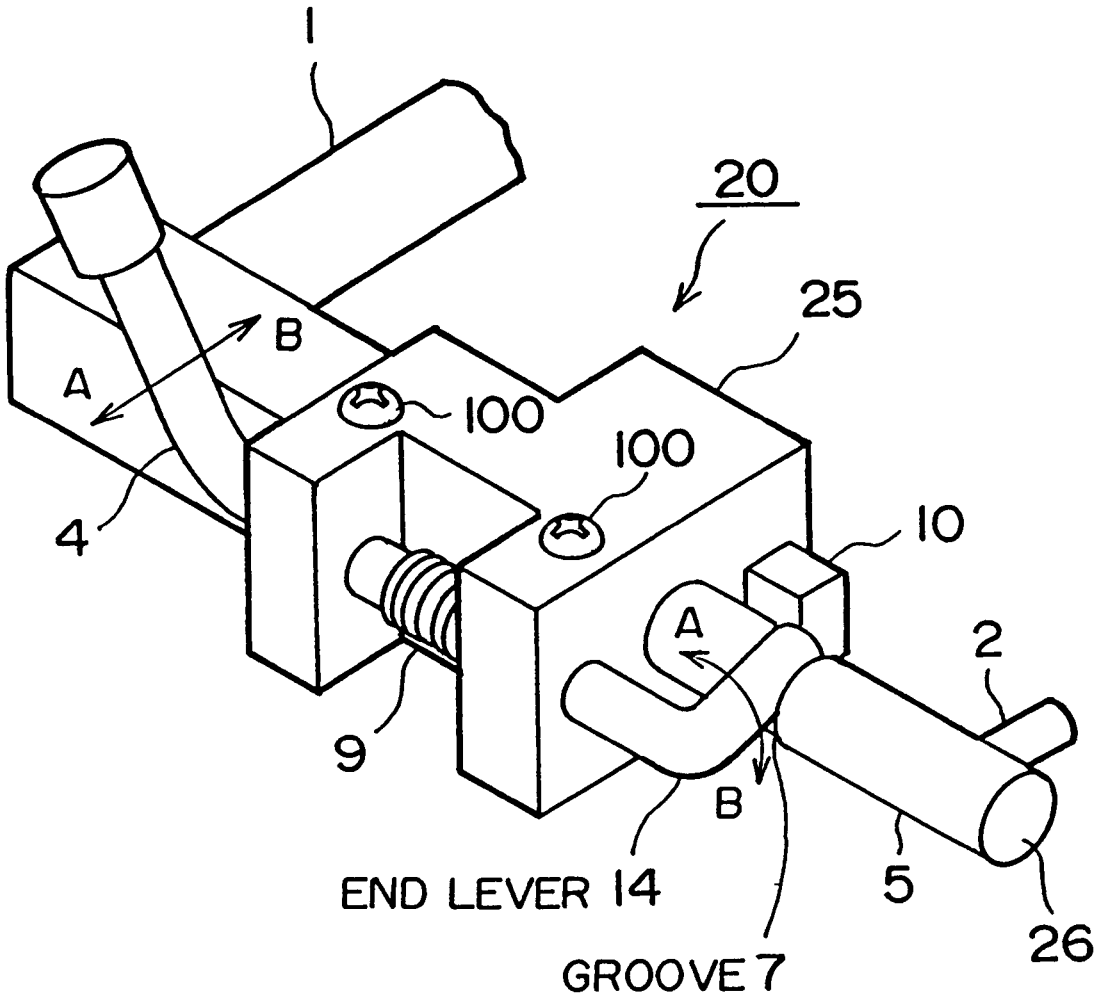
FIG. 5 is a perspective view of the first embodiment of the carrying handle mechanisms for a portable equipment shown in FIG. 1.

FIGS. 1, 3 and 5 show the carrying handle mechanisms 20 of the first embodiment fixed in the accommodated position.

Figure 2:
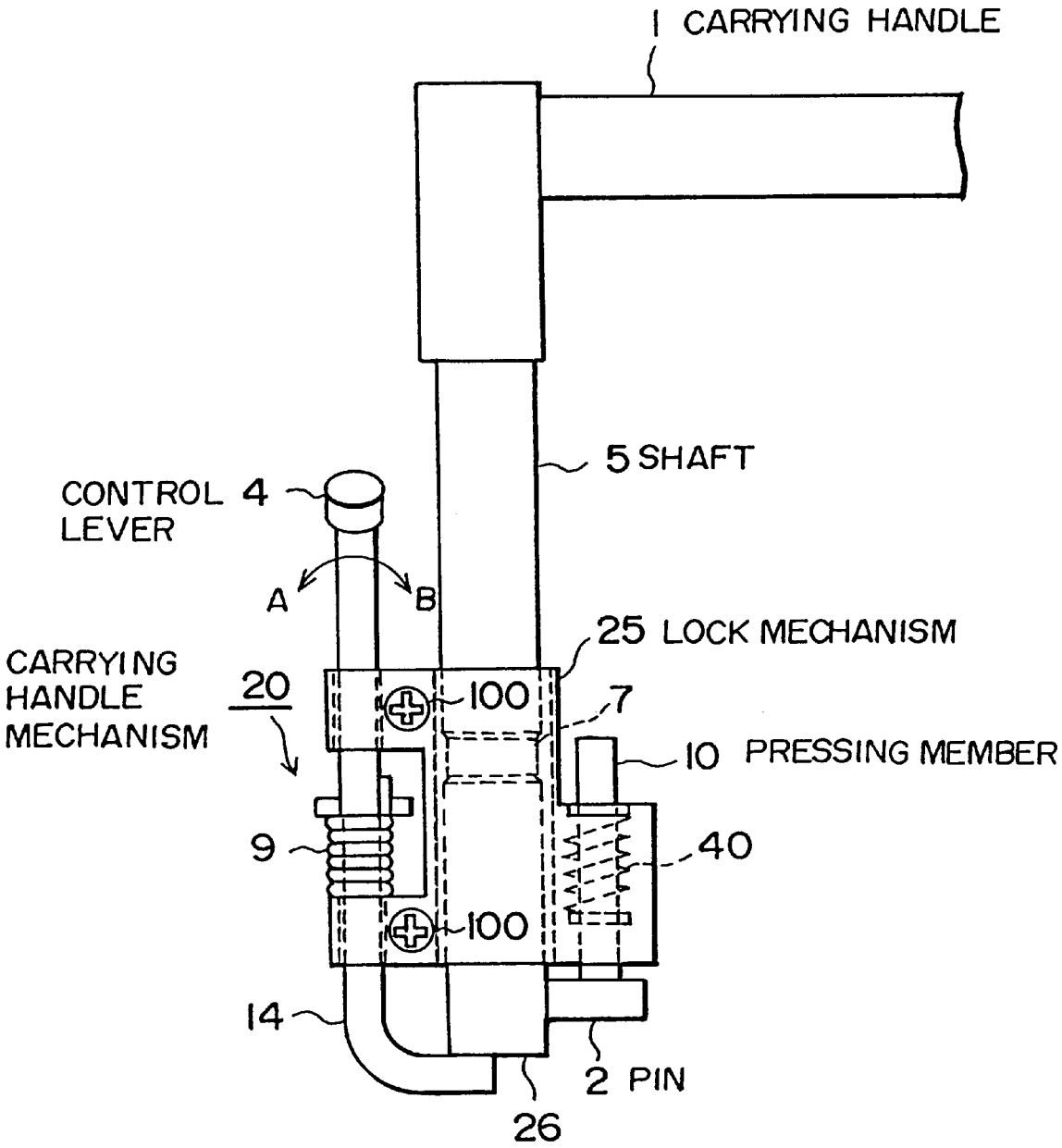
FIG. 2 is a plan view of the first embodiment of the carrying handle mechanisms for a portable equipment according to the present invention in a pulled-out use position.
Figure 4:
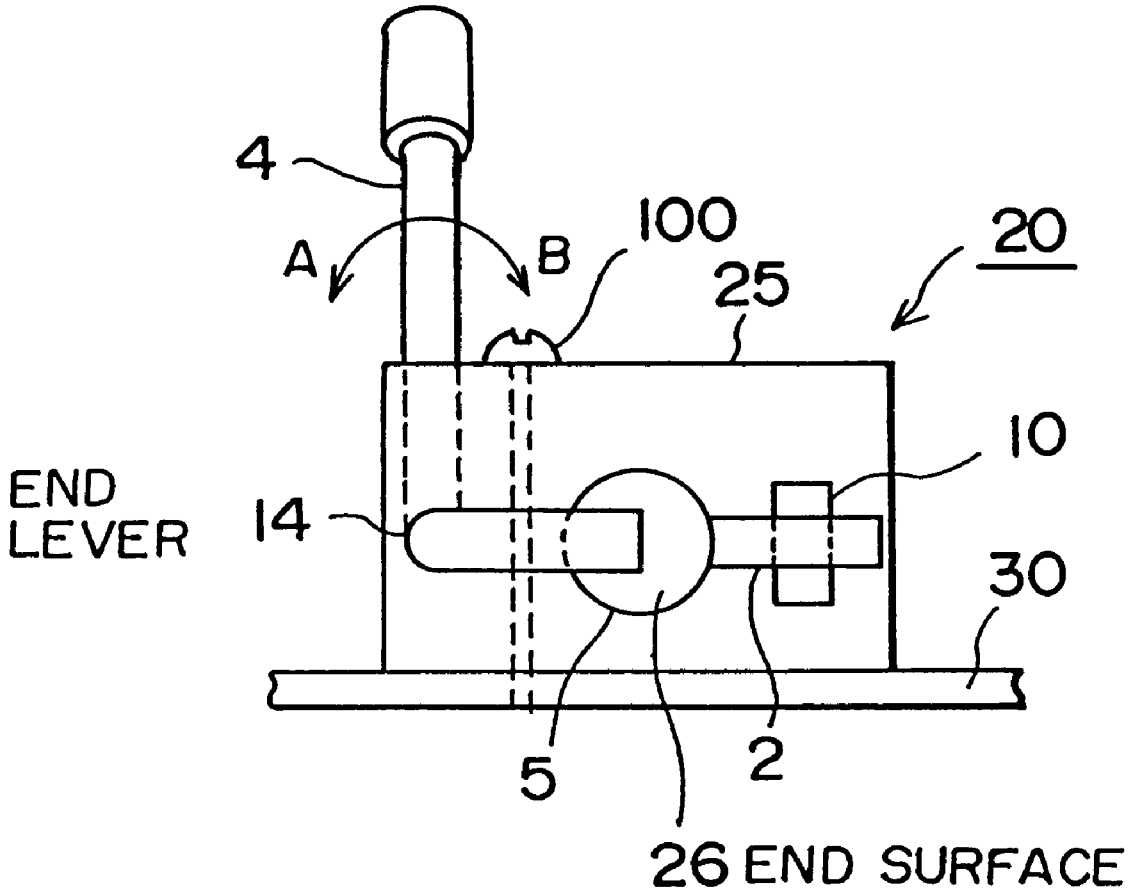
FIG. 4 is a front view of the first embodiment of the carrying handle mechanisms for a portable equipment shown in FIG. 2.
Figure 6:
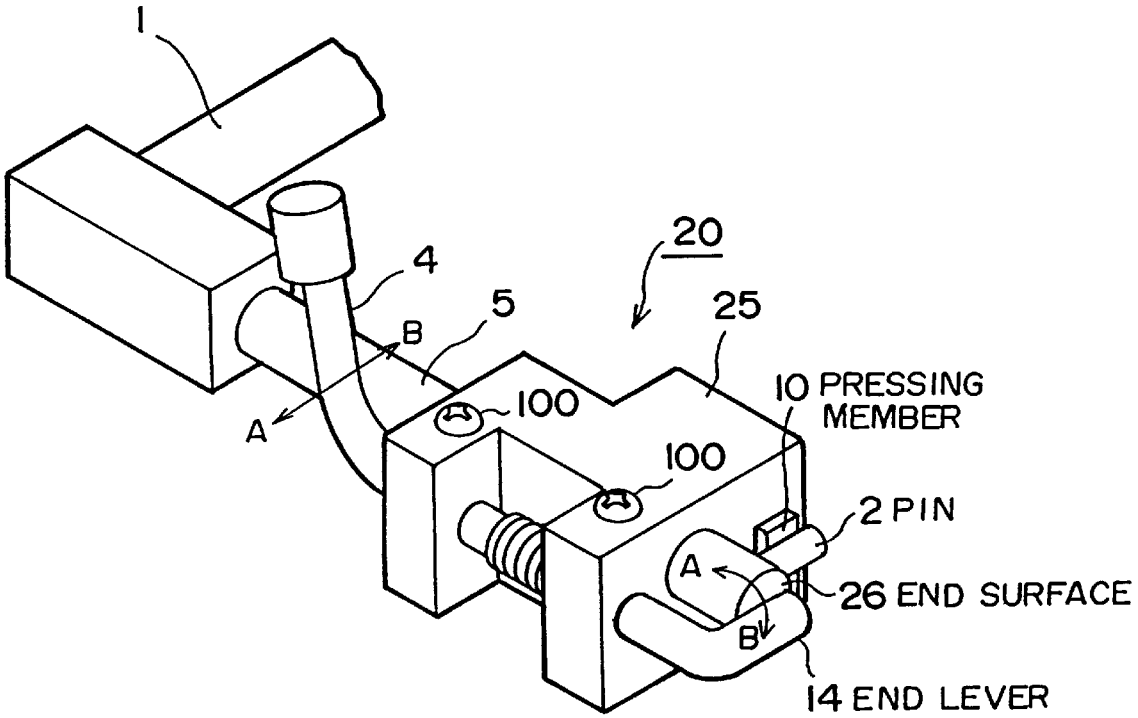
FIG. 6 is a perspective view of the first embodiment of the carrying handle mechanisms for a portable equipment shown in FIG. 2.

FIGS. 2, 4 and 6 show the carrying handle mechanisms 20 of the first embodiment fixed in the pulled-out use position.

In FIG. 1, in the carrying handle mechanisms 20 for use in the portable equipment body 30 including a projector (not shown) having the carrying handle 1 which can be pulled out from both the sides of the portable equipment body 30 and to which forces of coil springs 40 are applied in the accommodating direction Y that the carrying handle 1 is pushed into the portable equipment body 30, and the control levers 4 for locking the shafts 5, 5' while the shafts 5, 5' moved with the carrying handle 1 and the carrying handle 1 remain the pulled-out use position from the body 30. The forces are always applied to outer surfaces 26 of the shafts 5, 5' connected to both the ends of the carrying handle 1 so that the appropriate end levers 14 constituting the ends of the control levers 4 may be pressed against the outer surfaces. A movement of the carrying handle 1 allows the end levers 14 to be engaged with the end surfaces 26 perpendicular to center axes of the shafts 5, 5' at the end of the shafts 5, 5' from the outer surfaces 26 of the shafts 5, 5'. This permits the shafts 5, 5' to be fixedly retained in the pulled-out use position.

Moreover, between the grooves 7 and the free end surfaces 26 in the shafts 5, 5', disposed are contact pins 2 protruding from the surfaces of the shafts 5, 5' in a direction different from an axial direction of the shafts 5, 5'.

In addition, preferably, the lock mechanisms 25 further have the pressing members 10 to which the forces are applied at all times so that the shafts 5, 5' may be moved into the portable equipment body 30.

When the carrying handle 1 is accommodated as shown in FIGS. 1, 3 and 5, the control levers 4 are modified, whereby the end levers 14 of the control levers 4 are rotated in a direction A that the lock is released. The shafts 5, 5' are thus pressed into the portable equipment body 30 by means of pressing members 10 to which forces are applied so that the shafts 5, 5' may be moved in the accommodating direction Y that the shafts 5, 5' are directed into the portable equipment body 30. Furthermore, an operator presses the carrying handle 1 in the accommodating direction Y, whereby the end levers 14 of the control levers 4 are engaged with the grooves 7 disposed on the course of the shafts 5, 5', where the shafts 5, 5' of the carrying handle 1 are fixedly retained.

Therefore, in the carrying handle mechanisms 20, the carrying handle 1 is pulled out from the portable equipment body 30 and then locked as shown in FIGS. 2, 4 and 6, whereby the portable equipment body 30 can be moved and lifted by grasping the carrying handle 1. Thus, unlike the prior art in which the carrying or lifting operation is carried out by gripping the portable equipment body 30 with hands or fingertips alone, the body 30 can be retained in a very stable state. Therefore, the portable equipment body 30 can be lifted and moved in various attitudes such as an upside-down attitude, a right-side-down attitude or a left-side-down attitude only.

In the carrying handle mechanisms 20 according to FIGS. 2, 4 and 6, when the carrying handle 1 is not used, the lock is released, whereby the carrying handle 1 is moved into the portable equipment body 30 by the above-described forces of the coil springs 40 applied to the pressing members 10 toward an inside of the portable equipment body 30. Thus, the carrying handle 1 can be easily accommodated by hand as shown in FIGS. 1, 3 and 5. It is therefore possible to prevent an occurrence of injury, that is, to prevent the occurrence that the operator suffers injury caused by the hands or fingers being caught between the carrying handle 1 and the portable equipment body 30.

Furthermore, at the time of accommodating the carrying handle 1 as shown in FIGS. 1, 3 and 5, the end levers 14 of the control levers 4 are engaged with the concave grooves 7 disposed on the shafts 5, 5'. Therefore, since the shafts 5, 5' are fixedly retained in that position, a treatment is easy.

Hereinafter, the example of the carrying handle mechanisms 20 in FIGS. 1 through 6 will be described in more detail.

When the carrying handle 1 of the carrying handle mechanisms 20 is in the accommodated position as shown in FIGS. 1, 3 and 5, the contact pins 2 are not in contact with the pressing members 10 disposed on the lock mechanisms 25.

However, when the carrying handle 1 is located in the pulled-out use position as shown in FIGS. 2, 4 and 6, the contact pins 2 are in contact with the pressing members 10 of the lock mechanisms 25. The contact pins 2 are then operated so that the pressing members 10 may be pressed outward from the portable equipment body 30 against the forces of the coil springs 40 which are applied to the pressing members 10 into the portable equipment body 30.

That is, when the carrying handle 1 is in the pulled-out use position as shown in FIGS. 2, 4 and 6, the contact pins 2 of the shafts 5, 5' are engaged with the ends of the pressing members 10 disposed on the lock mechanisms 25. The pressing members 10 are thus pressed from the lock mechanisms 25 in the pulling-out use direction X that the carrying handle 1 is pulled out against the forces applied to the pressing members 10.

Moreover, in the control levers 4 for use in the carrying handle mechanisms 20, the forces are always applied to the control levers 4 by means of the appropriate springs 9 or the like so that the end levers 14 of the control levers 4 may be in contact with the surface of the shafts 5, 5'. Preferably, the modification of the control levers 4 allow the end levers 14 of the control levers 4 to be modified, whereby an engagement with the grooves 7 of the shafts 5, 5' or the free end surfaces 26 of the shafts 5, 5' may be selectively released.

On the other hand, the grooves 7 of the shafts 5, 5' function so that the end levers 14 of the control levers 4 may be fitted into the grooves 7 whereby the carrying handle 1 is fixed in the accommodated position when the carrying handle 1 is in the accommodated position.

More preferably, when the carrying handle 1 is moved from the pulled-out use position as shown in FIGS. 2, 4 and 6 to the accommodated position as shown in FIGS. 1, 3 and 5, the pressing members 10 allow the control levers 4 to be modified. When the end levers 14 of the control levers 4 are disengaged from the free end surfaces 26 of the shafts 5, 5', the shafts 5, 5' are temporarily moved into the portable equipment body 30 by a predetermined distance.

By employing such an arrangement, when the carrying handle 1 is accommodating, the control levers 4 on both the sides of the portable equipment body 30 are manually modified. The end levers 14 of the control levers 4 are then disengaged from the free end surfaces 26 of the shafts 5, 5', whereby the operation of the pressing members 10 allow the contact pins 2 to be moved into the portable equipment body 30 by a slight distance by the forces applied to the pressing members 10.

After then, the operator just slightly presses the carrying handle 1 by hand, whereby the carrying handle 1 can be easily accommodated in the portable equipment body 30 as shown in FIGS. 1, 3 and 5. There is no risk that the hands and fingers of the operator are injured during use of the present invention.

Therefore, in the carrying handle mechanisms 20, when the carrying handle 1 is accommodated as shown in FIGS. 1, 3 and 5, the end levers 14 of the control levers 4 are surely engaged with the grooves 7 disposed on the shafts 5, 5'. Accordingly, the carrying handle 1 is not moved by a slight shock and force and thus fixedly retained in a stable state.

Furthermore, when the carrying handle 1 is pulled out, the modification of the control levers 4 allow the end levers 14 of the control levers 4 to be separated from the grooves 7 disposed on the shafts 5, 5'. This separation permits the end levers 14 to be engaged with the outer surfaces of the shafts 5, 5'. The end levers 14 remain engaged with the outer surfaces of the shafts 5, 5', while the shafts 5, 5' are pulled out. As shown in FIGS. 2, 4 and 6, the contact pins 2 disposed on the shafts 5, 5' come into contact with the ends of the pressing members 10, whereby the pressing members 10 are pressed into the lock mechanisms 25.

As a result, resilient forces are applied to the shafts 5, 5' through the contact pins 2 by the coil springs 40 of the pressing members 10. The forces are thus applied to the shafts 5, 5' toward the inside of the portable equipment body 30. However, since the end levers 14 of the control levers 4 are engaged with the free end surface 26 of the shafts 5, 5', the shafts 5, 5' cannot be moved and thus the shafts 5, 5' are surely fixed in such a state.

That is, in this state as shown in FIGS. 2, 4 and 6, the end levers 14 of the control levers 4 function as stoppers for the shafts 5, 5'.

The engagement of the contact pins 2 with the pressing members 10 of the lock mechanisms 25 also prevents the carrying handle 1 from being further outwardly pulled out.

Figure 7:
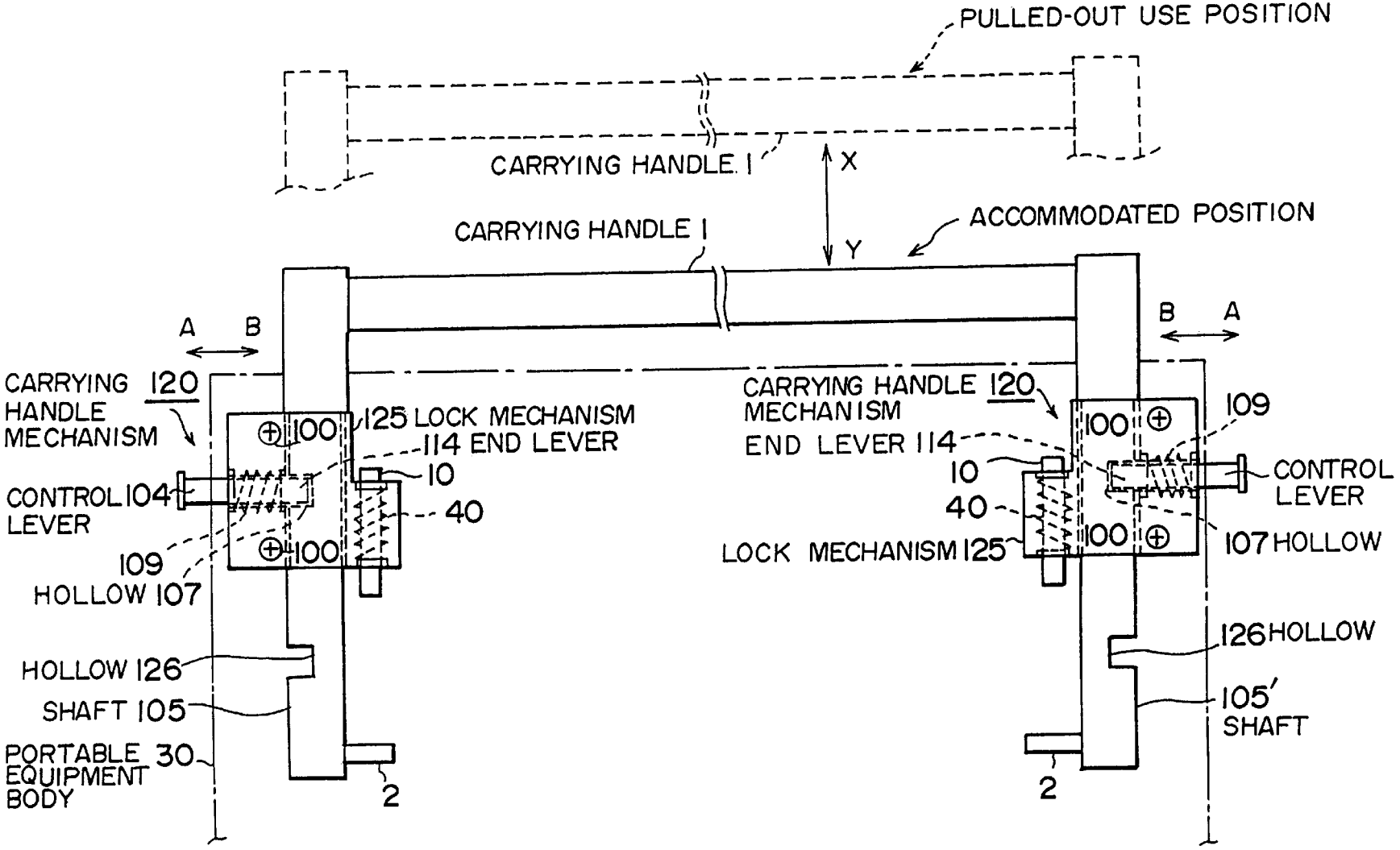
FIG. 7 is a plan view of a second embodiment of the carrying handle mechanisms for a portable equipment according to the present invention in an accommodated position.
Figure 8:
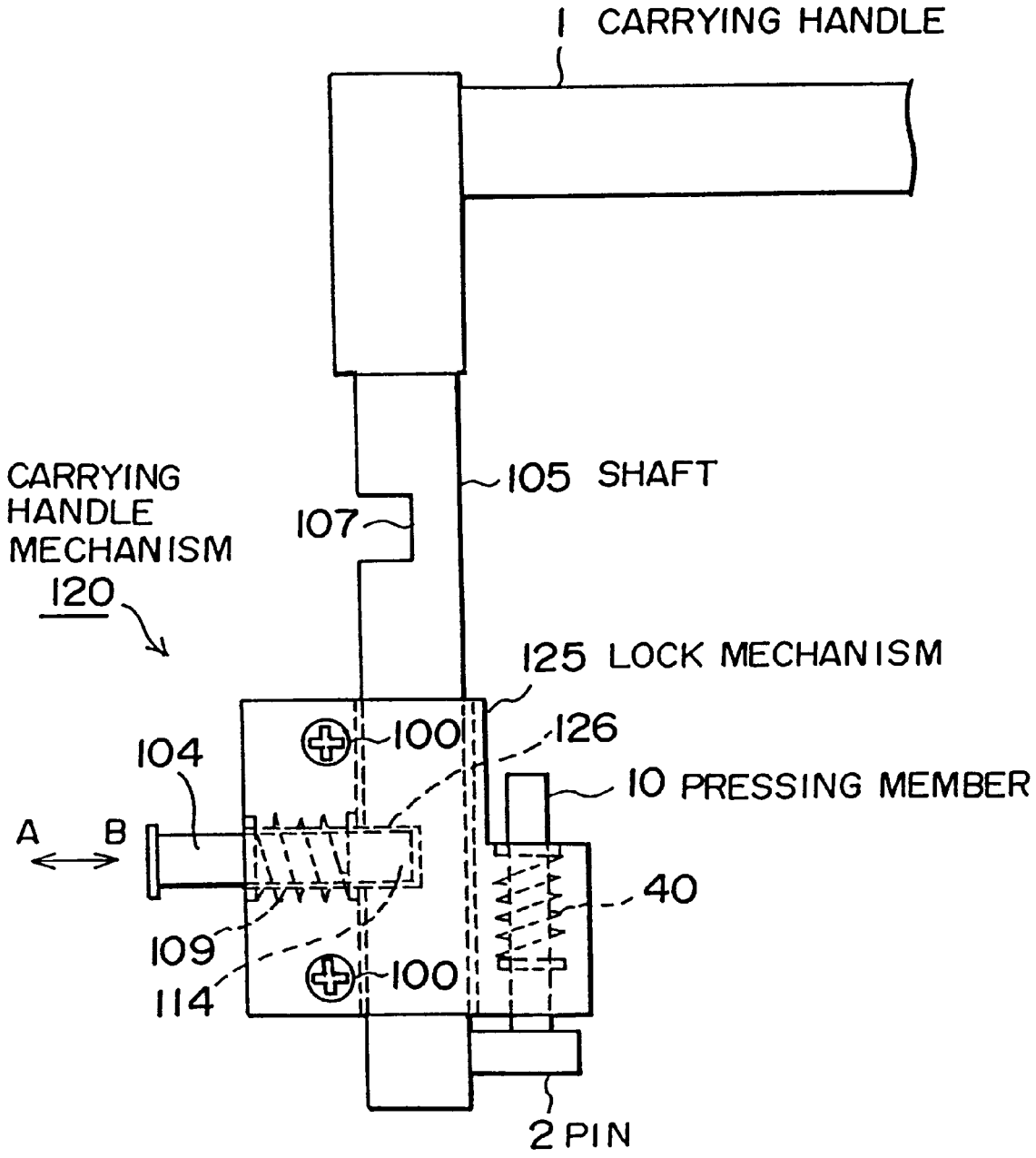
FIG. 8 is a plan view of the second embodiment of the carrying handle mechanisms for a portable equipment according to the present invention in a pulled-out use position.

FIG. 7 is a plan view of a second embodiment of the carrying handle mechanisms 20 for a portable equipment according to the present invention in an accommodated position. FIG. 8 is a plan view of the second embodiment of the carrying handle mechanisms for a portable equipment according to the present invention in a pulled-out use position.

In FIG. 7, the carrying handle mechanisms 120 have a pair of shafts 105, 105' disposed on both sides of a portable equipment body 30 and arranged to be forwardly/backwardly slidable in a pulling-out direction X; an accommodating direction Y through lock mechanisms 125, 125' with respect to the body 30 and a carrying handle 1 fixed to same ends of the shafts 125, 125' for connecting therebetween. The lock mechanisms 125, 125' include control levers 104 having end levers 114 engageable with the shafts 105, 105' under predetermined pressing forces at all times by, for example, action of appropriate springs 109. The lock mechanisms 125, 125' are fixed to the body 30 by screws 100. The shafts 105, 105' include hollows 107 with which the end levers 114 of the control levers 104 are engageable when the carrying handle 1 is in the accommodated position. The hollows 126 on the shafts 5, 5' are engageable with the end levers 114 of the control levers 104 when the carrying handle 1 is in a pulled-out use position as shown in FIG. 8.

In the state as shown in FIG. 8, when the carrying handle 1 is accommodated, the control levers 104 are modified, whereby the end levers 114 of the control levers 104 are rotated in a direction A that the lock is released. The shafts 105, 105' are thus pressed into the portable equipment body 30 by means of pressing members 10 to which forces are applied so that the shafts 105, 105' may be moved in the accommodating direction Y that the shafts 105, 105' are directed into the portable equipment body 30. Furthermore, an operator presses the carrying handle 1 in the accommodating direction Y, whereby the end levers 114 of the control levers 104 are engaged with the hollows 107 disposed on the course of the shafts 105, 105', where the shafts 105, 105' of the carrying handle 1 are fixedly retained as shown in FIG. 7.

The carrying handle mechanisms 120 for use in the portable equipment body 30 including a projector (not shown) having the carrying handle 1 which can be pulled out from both the sides of the portable equipment body 30 as shown in FIG. 8 and to which forces of coil springs 40 are applied in the accommodating direction Y that the carrying handle 1 is pushed into the portable equipment body 30, and the control levers 104 for locking the shafts 105, 105' while the shafts 105, 105' moved with the carrying handle 1 and the carrying handle 1 remain the pulled-out use position from the body 30. The forces are always applied to the hollows 107, 126 on the shafts 105, 105' connected to both the ends of the carrying handle 1 so that the appropriate end levers 114 constituting the ends of the control levers 114 may be engaged to the hollows 107. A movement of the carrying handle 1 allows the end levers 114 to be engaged with the hollows 107, 126 perpendicular to center axes of the shafts 105, 105' on the shafts 105, 105' from the outer surfaces of the shafts 105, 105'. This permits the shafts 105, 105' to be fixedly retained in the pulled-out use position as shown in FIG. 8.

Moreover, a following modification is also possible in these embodiments, for example, in the first embodiment, if the control levers 4 were elongated toward the end lever 14, not the end lever 14 but middle part of the lever 4 would be engageable to the grooves 7 and the free end surfaces 26.

The carrying handle mechanisms employ a technical arrangement as described above. Thus, the carrying handle is pulled out from the portable equipment body, whereby the carrying handle is automatically locked and fixedly retained in the pulled-out use position. Therefore, the portable equipment body can be easily lifted and moved by grasping and gripping the carrying handle with the hands. Accordingly, unlike the prior art in which the operation is carried out only by gripping the body with the fingertips, the portable equipment body can be very stably arranged in various attitudes such as the upside-down attitude, the right-side-down attitude or the left-side-down attitude.

Furthermore, when the carrying handle is accommodated, a release of the lock mechanisms allow the carrying handle to be somewhat pushed into the portable equipment body by the spring force applied to the carrying handle. Accordingly, the accommodating operation is facilitated and thus the treatment is simplified.

What is claimed is:

1. A carrying handle mechanism for a portable equipment, comprising:

a first shaft disposed on a body of said portable equipment, said first shaft including a first locking portion and a second locking portion;

a second shaft disposed on the body of said portable equipment and in parallel relation to said first shaft, said second shaft also includes a first locking portion and a second locking portion;

a carrying handle fixed between said first shaft and said second shaft;

a first lock mechanism mounted to said first shaft, said first lock mechanism including a control member coupled thereto, said control member locking with said first locking portion of said first shaft when said carrying handle is in a retracted position and locking with said second locking portion of said first shaft when said carrying handle is in a pulled-out use position;

a second lock mechanism mounted to said second shaft, said second lock mechanism including a control member coupled thereto, said control member of said second lock mechanism locking with said first locking portion of said second shaft when said carrying handle is in said retracted position and locking with said second locking portion of said second shaft when said carrying handle is in said pulled-out use position;

first pressing means disposed on said control member of said first lock mechanism for applying a force on said control member of said first lock mechanism so that said control member of said first lock mechanism engages the first shaft under a predetermined pressing force applied at all times; and second pressing means disposed on said control member of said second lock mechanism for applying said force on said control member of said second lock mechanism so that said control member of said second lock mechanism engages the second shaft under a predetermined pressing force applied at all times.

2. The carrying handle mechanism for a portable equipment according to said claim 1, wherein said control member of said first lock mechanism and said second lock mechanism is a control lever which is rotated in said locked position with said first and second locking portion of said first shaft and said second shaft, respectively.

3. The carrying handle mechanism for a portable equipment according to said claim 1, wherein said control member of said first lock mechanism and said second lock mechanism is a control lever which is slidable in said locked position with said first and second locking portion of said first shaft and said second shaft, respectively.

4. The carrying handle mechanism for a portable equipment according to said claim 1, wherein said first pressing member and said second pressing member are springs.

5. The carrying handle mechanism for a portable equipment according to said claim 1, further comprising:

a first contact pin positioned between said first locking portion and said second locking portion of said first shaft; and a second contact pin positioned between said first locking portion and said second locking portion of said second shaft.

6. The carrying handle mechanism for a portable equipment according to said claim 5, further comprising:

a first pressing member contacting the first contact pin when said first shaft is in the pulled out position; and a second pressing member contacting the second contact pin when said second shaft is in the pulled out position.

7. The carrying handle mechanism for a portable equipment according to said claim 6, further comprising:

a first spring positioned about said first pressing member, said first spring providing a force to said first contact pin when said first shaft is in the pulled out position; and a second spring positioned about said second pressing member, said second spring providing a force to said second contact pin when said second shaft is in the pulled out position.

8. The carrying handle mechanism for a portable equipment according to said claim 6, wherein:

said first control member is fixed in said second locking position of said first shaft when said first spring provides said force to said first contact pin; and said second control member is fixed in said second locking position of said second shaft when said second spring provides said force to said second contact pin.

9. A carrying handle mechanism for a portable equipment, comprising:

a pair of shafts disposed on both sides a body of said portable equipment and each having a groove thereon and a free end surface;

a carrying handle fixed to ends of each of said shafts;

a pair of lock mechanisms for being forwardly/backwardly slidable on each of said shafts therethrough with respect to said body between an accommodated position and a pulled-out use position;

a pair of control levers rotatably fixed on each of said lock mechanisms in parallel with each of said shafts, said pair of control levers being engageable into each of said grooves when said carrying handle is in said accommodated position and being engageable on each of said free end surfaces when said carrying handle is in said pulled-out use position; and a pair of first springs fixed between each of said lock mechanisms and each of said control levers for pressing each of said control levers onto each of said shafts under a predetermined pressing force.

10. The carrying handle mechanism for a portable equipment as defined in claim 9, further comprising:

a pair of contact pins disposed between each of said grooves and each of said free end surfaces protruding from surfaces of each of said shafts in a direction different from axial directions of each of said shafts;

a pair of pressing members pressed by each of said contact pins toward a direction into said body; and a pair of second springs for pressing each of said contact pins toward said direction into said body.

* * * * *